US008879364B2

(12) United States Patent
Honda

(10) Patent No.: US 8,879,364 B2
(45) Date of Patent: Nov. 4, 2014

(54) ELECTRONIC DEVICE

(75) Inventor: Katsuyuki Honda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 497 days.

(21) Appl. No.: 13/104,277

(22) Filed: May 10, 2011

(65) Prior Publication Data

US 2011/0280108 A1 Nov. 17, 2011

(30) Foreign Application Priority Data

May 12, 2010 (JP) ..... 2010-109973

(51) Int. Cl.
*G04B 47/00* (2006.01)
*G04R 20/06* (2013.01)

(52) U.S. Cl.
CPC ..... *G04R 20/06* (2013.01)
USPC ..... 368/14; 368/21

(58) Field of Classification Search
USPC ..... 368/14, 21–22
See application file for complete search history.

(56) References Cited

U.S. PATENT DOCUMENTS 6,321,158 B1 * 11/2001 DeLorme et al. ..... 701/426
6,393,263 B1 * 5/2002 Hayashi ..... 455/145
6,728,533 B2 * 4/2004 Ishii ..... 455/425
7,190,946 B2 * 3/2007 Mazzara et al. ..... 455/404.1
7,689,448 B2 * 3/2010 Fu et al. ..... 705/7.19
7,821,875 B2 * 10/2010 Punkka ..... 368/21
2007/0217291 A1 * 9/2007 Jeong et al. ..... 368/21
2009/0135675 A1 5/2009 Akiyama

FOREIGN PATENT DOCUMENTS

EP 2085835 A2 8/2009
JP 2003-139875 5/2003
JP 2009-128296 6/2009

* cited by examiner

*Primary Examiner* — Sean Kayes

(57) ABSTRACT

An electronic device that can display the current time reduces the number of times that the time must be manually set. The electronic device 100 has a CPU 20 that keeps time internally, a display unit 50 that displays the time based on the internal time, a GPS device 10 that receives satellite signals and outputs satellite time information according to the positioning information and UTC, and EEPROM 32 that stores time zone information denoting the time difference to UTC for individual regions. The CPU 20 adjusts the displayed time based on the satellite time information and correction information. The CPU 20 also adjusts the displayed time based on an operation signal, and stores time difference information denoting the time difference between the displayed time after being adjusted and UTC linked to the region associated with the positioning information in flash ROM 33.

8 Claims, 7 Drawing Sheets

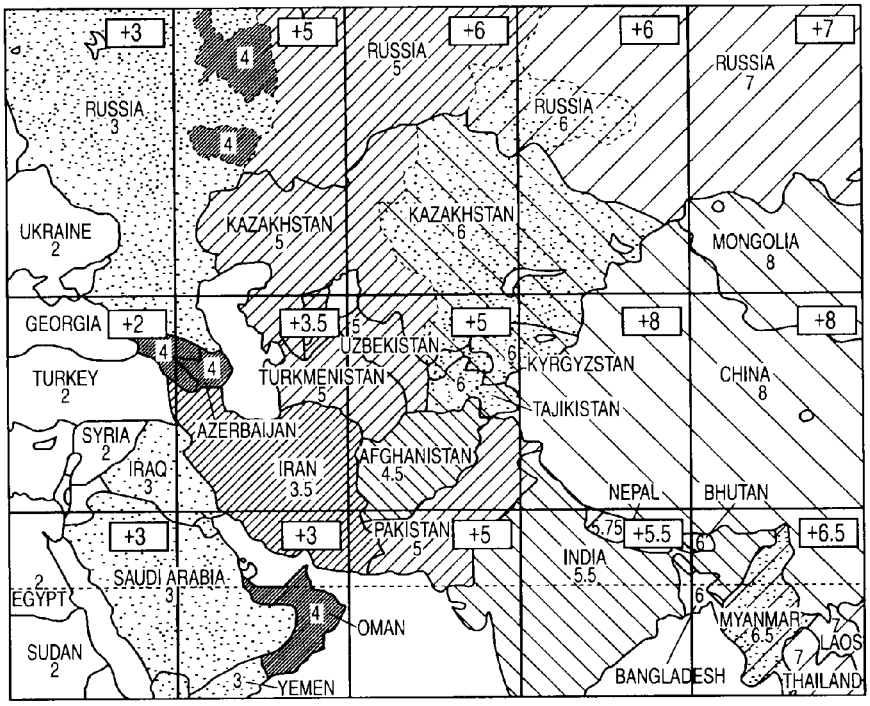

FIG. 3

| REGION NUMBER | NORTHWEST COORDINATE (LONGITUDE AND LATITUDE) | SOUTHEAST COORDINATE (LONGITUDE AND LATITUDE) | TIME DIFFERENCE (HOURS) | |
|---|---|---|---|---|
| 1 | E30,N60 | E45,N45 | +3 | FIRST CORRECTION DATA |
| 2 | E30,N45 | E45,N30 | +2 | FIRST CORRECTION DATA |
| 3 | E30,N30 | E45,N15 | +3 | FIRST CORRECTION DATA |
| ⋮ | ⋮ | ⋮ | ⋮ | |

FIG. 4

| REGION NUMBER | NORTHWEST COORDINATE (LONGITUDE AND LATITUDE) | SOUTHEAST COORDINATE (LONGITUDE AND LATITUDE) | TIME DIFFERENCE (HOURS) | |
|---|---|---|---|---|
| 2 | E30,N45 | E45,N30 | +3 | SECOND CORRECTION DATA |

FIG. 5

| REGION NUMBER | NORTHWEST COORDINATE (LONGITUDE AND LATITUDE) | SOUTHEAST COORDINATE (LONGITUDE AND LATITUDE) | TIME DIFFERENCE (HOURS) | AFFIRMATION COUNT (TIMES) |
|---|---|---|---|---|
| 2 | E30,N45 | E45,N30 | +3 | 3 |

SECOND CORRECTION DATA

| REGION NUMBER | NORTHWEST COORDINATE (LONGITUDE AND LATITUDE) | SOUTHEAST COORDINATE (LONGITUDE AND LATITUDE) | TIME DIFFERENCE (HOURS) | DST START (DATE, TIME) | DST END (DATE, TIME) |
|---|---|---|---|---|---|
| 1 | E30,N60 | E45,N45 | +3 | – | – |
| 2 | E30,N45 | E45,N30 | +2 | – | – |
| 3 | E30,N30 | E45,N15 | +3 | – | – |
| ⋮ | ⋮ | ⋮ | ⋮ | ⋮ | ⋮ |

FIG. 11

| REGION NUMBER | NORTHWEST COORDINATE (LONGITUDE AND LATITUDE) | SOUTHEAST COORDINATE (LONGITUDE AND LATITUDE) | TIME DIFFERENCE (HOURS) | DST START (DATE, TIME) | DST END (DATE, TIME) |
|---|---|---|---|---|---|
| 2 | E30,N45 | E45,N30 | +2 | – | – |

FIG. 12

ELECTRONIC DEVICE

BACKGROUND

1. Technical Field

The present invention relates to an electronic device that receives signals and obtains the current time transmitted from a positioning information satellite such as a GPS satellite.

2. Related Art

The Global Positioning System (GPS) uses GPS satellites (positioning information satellites) that orbit the Earth on known orbits and enables a GPS receiver (GPS device) to determine its own location from these GPS signals. Each GPS satellite carries an atomic clock, and transmits satellite signals that contain time information (satellite time information) representing the time (GPS time) that is kept by the atomic clock. The GPS time is the same on all GPS satellites, and UTC (Coordinated Universal Time) is determined by correcting the GPS time with the UTC offset (currently +15 seconds), which is the difference between GPS time and UTC. The UTC can therefore be determined by receiving a satellite signal and acquiring the GPS time from a GPS satellite, and then correcting the GPS time based on the UTC offset. The UTC offset can be acquired from the received satellite signal, or a specific value that is acquired from local storage could be acquired and used as the UTC offset.

A radio-controlled timepiece that receives satellite signals from GPS satellites to determine the current time is taught in Japanese Unexamined Patent Appl. Pub. JP-A-2003-139875. This radio-controlled timepiece keeps the current local time (local time), stores fixed location information identifying the position of plural fixed locations, such as major cities, correlated to time difference information indicating the time difference at that location, and calculates the current local time using the time information acquired from a satellite signal and the time difference information correlated to the fixed location that is closest to the position of the mobile device determined from the satellite signals. A circular area centered on a particular point is set for each fixed location, and the fixed location assigned to the area associated with the current position of the mobile device is used as the "closest fixed location."

Japanese Unexamined Patent Appl. Pub. JP-A-2009-128296 teaches an electronic timepiece that receives satellite signals from GPS satellites to determine the current time.

With the radio-controlled timepiece taught in JP-A-2003-139875, the time difference is determined based on whether or not the position of the mobile device is in a circular area. As a result, the current local time could be calculated using incorrect time difference information in regions where there are plural meandering time difference boundaries. For example, the current local time may be calculated using time difference information for a fixed location B neighboring location A even though the user intended for the current local time to be calculated using time difference information for fixed location A.

In this case the user must manually set the current local time. When the user visits the same location the next time, the current local time is again calculated using time difference information not intended by the user (that is, the time difference at location B), and the user must again manually set the current local time. The user must therefore always set the time manually in this location.

This problem is the same with the electronic timepiece taught in JP-A-2009-128296.

SUMMARY

An electronic device according to the present invention that can display the current time can reduce the number of times that the time must be set manually.

A first aspect of the invention is a electronic device including: a timekeeping unit that keeps internal time; a display unit that displays a display time based on the internal time; a reception unit that receives satellite signals transmitted from satellites and outputs positioning information and satellite time information corresponding to a reference time (such as UTC) based on the received signals; a first correction unit that adjusts the display time based on the satellite time information and correction information; a first storage unit that stores time zone information denoting the time difference to the reference time for each region; an operating unit that outputs an operation signal corresponding to user operations; a second correction unit that adjusts the display time based on the operation signal, and generates time difference information indicating the time difference between the reference time and the corrected display time; a second storage unit that correlates and stores the time difference information with the region identified by the positioning information; and a control unit. When positioning information is output from the reception unit, the control unit executes a process that determines if the positioning information identifies a region corresponding to time difference information stored in the second storage unit; executes a process that supplies the time difference information as the correction information to the first correction unit when the positioning information identifies a region in the second storage unit; and when the positioning information does not identify a region in the second storage unit, executes a process that references the first storage unit and supplies the time zone information corresponding to the region identified by the positioning information as the correction information to the first correction unit.

An electronic device according to this aspect of the invention can display the current local time (regional time) because the display time is adjusted based on satellite time information obtained from a satellite signal, and either time zone information stored in a first storage unit or time difference information stored in a second storage unit.

When the display time is adjusted to a (first time+<) according to operation of the operating unit after the display time is adjusted to the first time based on the satellite time information and time zone information obtained from the received satellite signal in an electronic device according to this first aspect of the invention, time difference information indicating the time difference (<) between the first time and (first time+<) is stored in the second storage unit correlated to the region associated with the positioning information obtained from the satellite signal. At this time, the time (first time+<) obtained by adjustment according to the operation of the operating unit (manual adjustment) is the time intended by the user for that region, and < is the time difference intended by the user for that region.

If satellite signals are received at a later time and positioning information associated with the same region is received again, the electronic device according to this first aspect of the invention adjusts the display time based on the time difference information stored in the second storage unit (the time difference information representing <) and the satellite time information obtained from the satellite signal (satellite time information indicating a second time). This adjustment results in the display time becoming (second time+<) for example. More specifically, the time difference (<) that was previously set by the user in that region is reflected in the display time without manual adjustment.

As a result, the electronic device according to this first aspect of the invention can reduce the number of times the time is manually adjusted.

An electronic device that can display the current local time according to the invention can reduce the number of times the user needs to manually set the time. In addition, because the time difference information is written to a second storage unit that is different from the first storage unit that stores the time zone information, this first aspect of the invention can be rendered more easily using a configuration that stores a single block of compressed data obtained by compressing time zone information for plural regions (a configuration that reduces the storage capacity required in the first storage unit) than a configuration that rewrites the time zone information with the time difference information.

In an electronic device according to another aspect of the invention, the control unit counts the number of times that, after the time difference information is generated, positioning information for the region corresponding to the time difference information is output from the reception unit but the display time corrected in the first correction unit is not corrected in the second correction unit, and overwrites the time zone information in the first storage unit with the time difference information when the count reaches a specific value.

Because the time difference information written to the first storage unit as time zone information does not need to be stored in the second storage unit, this aspect of the invention can reduce the storage capacity required in the second storage unit. In addition, because the number that is counted is the number of times manual adjustment is not performed, that is, the number of times that the display time is affirmed by the user (affirmation count), only high reliability time difference information is written as time zone information to the first storage unit. The number of times time zone information is rewritten can therefore be reduced compared with a configuration that rewrites the time zone information every time difference information is produced.

In an electronic device according to another aspect of the invention, the display unit displays a daylight saving time symbol indicating whether or not daylight saving time is in effect; the first storage unit stores daylight saving time information specifying the daylight saving time period for each region; the second correction unit corrects displaying the daylight saving time symbol that is presented on the display unit based on the operation signal, and generates corrected daylight saving time information indicating the corrected date and time; and the control unit executes a process of storing the corrected daylight saving time information correlated to the region identified by the positioning information in the second storage unit when a user operates the operating unit and changes the daylight saving time symbol displayed on the display unit, and when positioning information is output from the reception unit, executes a process of determining if the positioning information identifies a region corresponding to time difference information stored in the second storage unit, executes a process of supplying information reflecting the corrected daylight saving time information in the time difference information as the correction information to the first correction unit when the positioning information identifies said region, and executes a process of referencing the first storage unit and supplying information reflecting the daylight saving time information in the time zone information for the region identified by the positioning information as the correction information to the first correction unit when the positioning information does not identify said region.

This aspect of the invention can display the correct current local time even in places where daylight saving time (summer time) is used because daylight saving time (DST) information or corrected DST information is reflected in adjustments due to a time difference. The period when daylight saving time is in effect and whether daylight saving time is used can be changed by law. However, in this aspect of the invention, if the user adjusts whether or not indication of daylight saving time is displayed in conjunction with adjusting the time due to a time difference, corrected daylight saving time information corresponding to the corrected display time is stored in the second storage unit correlated to the region, and the corrected daylight saving time information is reflected the next time the display time is adjusted due to a time difference in that region. As a result, this aspect of the invention can reduce the number of times the display time is manually adjusted.

An electronic device according to a second aspect of the invention includes: a timekeeping unit that keeps internal time; a display unit that displays a display time based on the internal time; a reception unit that receives satellite signals transmitted from satellites and outputs positioning information and satellite time information corresponding to a reference time (such as UTC) based on the received signals; a first correction unit that adjusts the display time based on the satellite time information and correction information; a first storage unit that stores time zone information denoting the time difference to the reference time for each region; an operating unit that outputs an operation signal corresponding to user operations; a second correction unit that adjusts the display time based on the operation signal, and generates time difference information indicating the time difference between the reference time and the corrected display time; a second storage unit that correlates and stores the time difference information and the positioning information; and a control unit. When positioning information is output from the reception unit, the control unit executes a process that calculates the distance between the positioning information output from the reception unit and the positioning information stored in the second storage unit, a process that determines if the calculated distance is less than or equal to a specific distance, a process that supplies the time difference information as the correction information to the first correction unit when the calculated distance is less than the specific distance, and a process that supplies the time zone information as the correction information to the first correction unit when the calculated distance is less than the specific distance.

An electronic device according to this second aspect of the invention can display the current local time (regional time) in the same way as the electronic device according to the first aspect of the invention described above.

When the display time is adjusted to a (first time+<) according to operation of the operating unit after the display time is adjusted to the first time based on the satellite time information and time zone information obtained from the received satellite signal in an electronic device according to this second aspect of the invention, time difference information indicating the time difference (<) between the first time and (first time+<) is stored in the second storage unit correlated to the positioning information (first positioning information) obtained from the satellite signal. At this time, the time (first time+<) obtained by adjustment according to the operation of the operating unit (manual adjustment) is the time intended by the user for that region, and < is the time difference intended by the user for that region.

If satellite signals are received at a later time and positioning information (second positioning information) for a location that is less than or equal to a specific distance from the first positioning information stored in the second storage unit is received again, the electronic device according to this second aspect of the invention adjusts the display time based on the time difference information stored in the second storage unit (the time difference information representing <) and the satellite time information obtained from the satellite signal (satellite time information indicating a second time). This adjustment results in the display time becoming (second time+<), for example. More specifically, the time difference (<) that was previously set by the user for a location (the location identified by the first positioning information) near the location identified by the second positioning information is reflected in the display time without manual adjustment.

As a result, the electronic device according to this aspect of the invention can reduce the number of times the time is manually adjusted.

An electronic device that can display the current local time according to the invention can reduce the number of times the user needs to manually set the time. In addition, because the time difference information is written to a second storage unit that is different from the first storage unit that stores the time zone information, this second aspect of the invention can be rendered more easily using a configuration that stores a single block of compressed data obtained by compressing time zone information for plural regions (a configuration that reduces the storage capacity required in the first storage unit) than a configuration that rewrites the time zone information with the time difference information.

In an electronic device according to another aspect of the invention, the control unit counts the number of times that, after the time difference information is generated, positioning information for a location at a distance that is less than or equal to a specific distance from the location identified by the positioning information for the region corresponding to the time difference information is output from the reception unit but the display time corrected in the first correction unit is not corrected in the second correction unit, and overwrites the time zone information in the first storage unit with the time difference information when the count reaches a specific value.

Because the time difference information written to the first storage unit as time zone information does not need to be stored in the second storage unit, this aspect of the invention can reduce the storage capacity required in the second storage unit. In addition, because the number that is counted is the number of times manual adjustment is not performed, that is, the number of times that the display time is affirmed by the user (affirmation count), only high reliability time difference information is written as time zone information to the first storage unit. The number of times time zone information is rewritten can therefore be reduced compared with a configuration that rewrites the time zone information every time difference information is produced.

In an electronic device according to another aspect of the invention, the display unit displays a daylight saving time symbol indicating whether or not daylight saving time is in effect; the first storage unit stores daylight saving time information specifying the daylight saving time period for each region; the second correction unit corrects displaying the daylight saving time symbol that is presented on the display unit based on the operation signal, and generates corrected daylight saving time information indicating the corrected date and time; and the control unit executes a process of storing the corrected daylight saving time information correlated to the positioning information in the second storage unit when a user operates the operating unit and changes the daylight saving time symbol displayed on the display unit. When positioning information is output from the reception unit, the control unit executes a process of calculating the distance between the positioning information output from the reception unit and the positioning information stored in the second storage unit, executes a process of determining if the calculated distance is less than or equal to a specific distance, executes a process of supplying information reflecting the corrected daylight saving time information in the time difference information as the correction information to the first correction unit when the calculated distance is less than or equal to the specific distance, and executes a process of supplying information reflecting the daylight saving time information in the time zone information as the correction information to the first correction unit when the calculated distance exceeds the specific distance.

This aspect of the invention can display the correct current local time even in places where daylight saving time (summer time) is used because daylight saving time (DST) information or corrected DST information is reflected in adjustments due to a time difference. The period when daylight saving time is in effect and whether daylight saving time is used can be changed by law. However, in this aspect of the invention, if the user adjusts whether or not indication of daylight saving time is displayed in conjunction with adjusting the time due to a time difference, corrected daylight saving time information corresponding to the corrected display time is stored in the second storage unit correlated to region information, and the corrected daylight saving time information is reflected the next time the display time is adjusted due to a time difference related to a region that is less than or equal to a specific distance from the previously stored region. As a result, this aspect of the invention can reduce the number of times the display time is manually adjusted.

In an electronic device according to another aspect of the invention, the second correction unit preferably generates the time difference information when the display time is corrected based on the operation signal before a specific time passes after the positioning information is output.

When the display time is adjusted based on an operation signal after a specific time has passed after the positioning information is output, that is, when the time is manually adjusted separately from adjusting the time due to a time zone difference, time difference information is not generated. As a result, use of an inappropriate time difference as the time difference intended by the user can be prevented.

Further preferably in another aspect of the invention, the first storage unit stores time zone information for regions segmented by longitude and latitude.

This aspect of the invention enables using relatively little information to identify regions, and can therefore reduce the storage capacity required in the first storage unit. For example, a configuration that stores time zone information for individual regions that match the actual time zone boundaries requires a large amount of information to identify the regions because of the shapes of the actual time zone regions are complex. However, a device that stores time zone information for regions that are delineated by longitude and latitude only requires the coordinates (longitude and latitude) of two positions for each region. In addition, an electronic device according to the first aspect of the invention in which the first storage unit stores the time zone information for individual regions segmented by longitude and latitude has the advantage of being able to determine the region associated with the positioning information by means of a simple operation.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 3 shows an example of setting the time difference in particular geographical regions in the electronic device 100.

FIG. 4 schematically describes an example of first correction data stored in EEPROM 32 in the electronic device 100.

FIG. 5 schematically describes an example of second correction data stored in flash ROM 33 in the electronic device 100.

FIG. 11 schematically describes an example of first correction data stored in EEPROM 32 in an electronic device according to a first variation of the first embodiment.

FIG. 12 schematically describes an example of second correction data stored in flash ROM 33 in the electronic device according to the first variation of the first embodiment.

DESCRIPTION OF EMBODIMENTS

Preferred embodiments of the present invention are described below with reference to the accompanying figures.

Note that the embodiments described below are specific preferred embodiments of the invention and accordingly describe various technically preferable limitations. However, unless otherwise stated, the invention is not limited to the following embodiments and can be varied and modified in many ways without departing from the scope of the accompanying claims.

A Embodiment 1

A-1 Configuration

The configuration of a electronic device 100 according to a first embodiment of the invention is described below.

Figure 1:
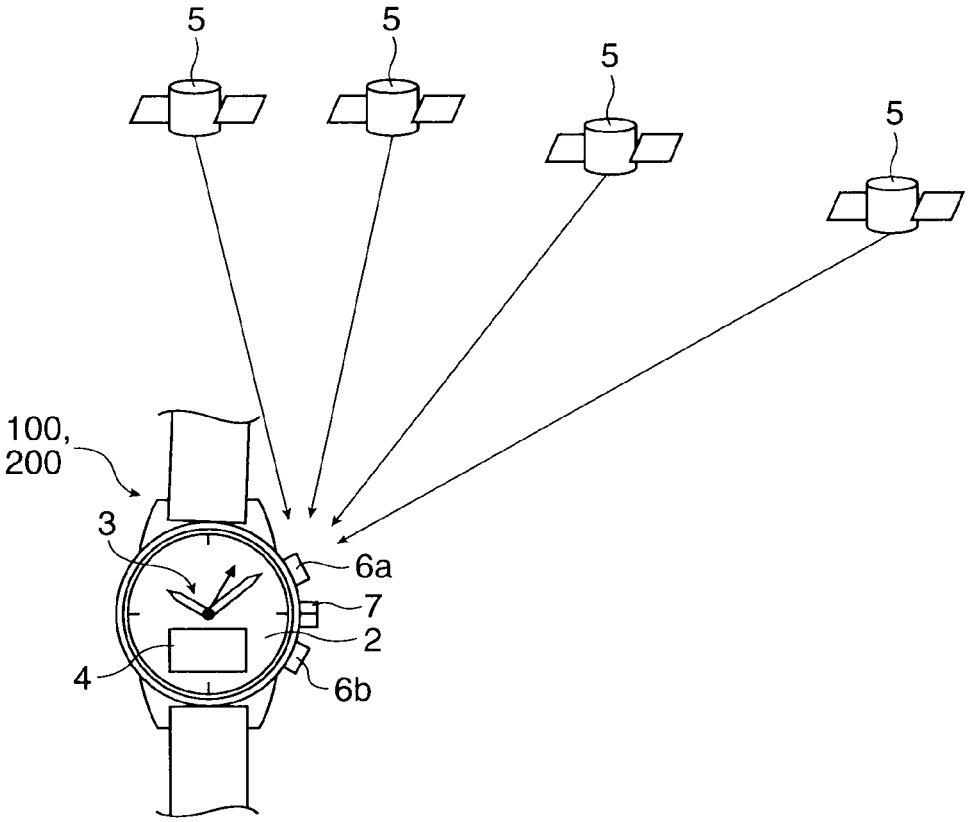
FIG. 1 shows an example of an electronic device 100 according to a first embodiment of the invention.

FIG. 1 shows the appearance of an electronic device 100. As will be known from FIG. 1, the electronic device 100 is an electronic timepiece that displays the internally kept time, and has an analog display unit with a dial 2 and hands 3. A window is rendered in the dial 2, and a display 4 (digital display unit) is disposed in this window. The electronic device 100 is thus a combination timepiece that has both an analog display unit and a digital display unit as the display unit 50 described below for displaying the display time based on the internal time.

Note that in this embodiment of the invention the display time is the internal time, and correcting the display time means correcting the internal time.

The hands 3 include a second hand, minute hand, and hour hand, and are driven by a stepper motor and wheel train.

The display 4 is an LCD panel, for example, and is used to display various information.

The electronic device 100 also has buttons 6*a* and 6*b* and a crown 7 that are operated by the user. The buttons 6*a* and 6*b* and crown 7 output corresponding operation signals. The electronic device 100 thus has an operating unit 40 that outputs operation signals according to user operations.

The electronic device 100 receives satellite signals from a plurality of GPS satellites 5 orbiting the Earth on known orbits, and can correct the display time by acquiring the satellite time information denoting the GPS time and acquire and display positioning information (navigation information) for the current location on the display 4 from the received satellite signals. This satellite time information corresponds to UTC (standard time) because UTC is obtained by correcting GPS time with the UTC offset. Note that a GPS satellite 5 is an example of a positioning information satellite in this embodiment of the invention, and plural GPS satellites 5 are in orbit around the Earth. There are currently approximately thirty GPS satellites 5 in orbit.

Figure 2:
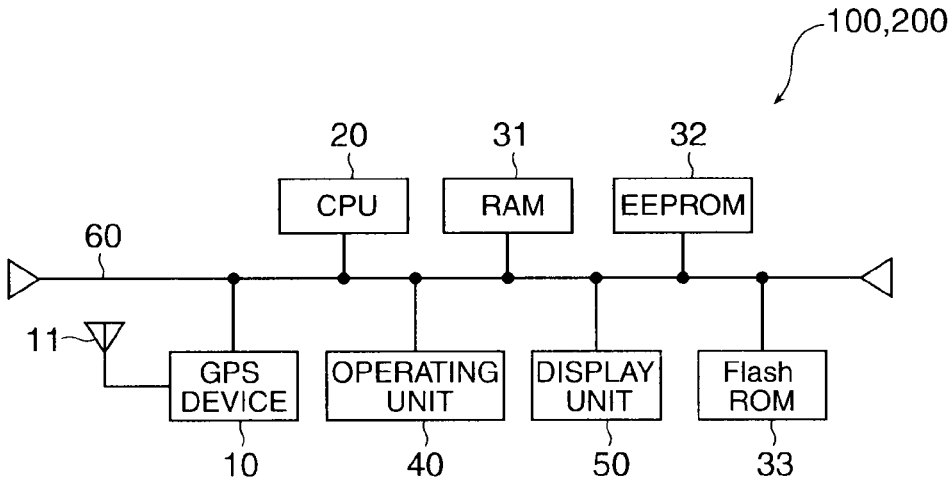
FIG. 2 is a block diagram showing circuits of the electronic device 100.

FIG. 2 is a block diagram showing circuits in the electronic device 100. As shown in FIG. 2, the electronic device 100 includes a GPS device 10 (GPS module), CPU 20 (central processing unit), RAM (random access memory) 31, EEPROM (electrically erasable and programmable read only memory) 32, flash ROM 33 (flash memory), a operating unit 40, and a display unit 50. These devices exchange data over a data bus 60.

The electronic device 100 also has an internal battery as a power source. The battery may be a primary cell or a rechargeable storage battery.

The GPS device 10 has a GPS antenna 11, and processes satellite signals received through the GPS antenna 11 to acquire satellite time information and positioning information. The GPS antenna 11 is a patch antenna that receives satellite signals from a plurality of GPS satellites 5 orbiting the Earth on fixed orbits, is disposed behind the dial 2, and receives signals passing through the crystal and the dial 2 of the electronic device 100. As a result, the dial 2 and crystal are made from materials that pass RF signals such as the satellite signals transmitted from the GPS satellites 5. The dial 2 may be made of plastic, for example.

Although not shown in the figures, the GPS device 10 has an RF (radio frequency) unit that receives and digitizes satellite signals transmitted from the GPS satellites 5, a baseband unit that applies a correlation process to the received signals to demodulate the navigation message, and a data acquisition unit that acquires and outputs satellite time information and positioning information (navigation information) from the navigation message (satellite signal) demodulated by the baseband unit similarly to a common GPS receiver. In other words, the GPS device 10 receives satellite signals transmitted from the GPS satellite 5, and functions as a reception unit that outputs satellite time information and positioning information based on the result of the satellite signal reception process.

The RF unit includes a bandpass filter, PLL circuit, IF filter, VCO (voltage controlled oscillator), analog/digital (A/D) converter, mixer, LNA (low noise amplifier), and intermediate frequency (IF) amplifier. The satellite signal extracted by the bandpass filter is amplified by a low noise amplifier, mixed with the VCO output signal by the mixer, and downconverted to an IF (intermediate frequency) signal. The IF signal output from the mixer passes through the IF amplifier and IF filter, and is converted by the A/D converter to a digital signal.

The baseband unit includes a local code generating unit and a correlation unit. The local code generating unit generates a local code identical to the C/A code used for transmission by a GPS satellite 5. The correlation unit calculates the correlation between this local code and the C/A code in the reception signal output from the RF unit. If the correlation value calculated by the correlation unit is greater than or equal to a specified threshold value, the C/A code used in the received satellite signal and the generated local code match, and the satellite signal can be captured (synchronized). As a result, the navigation message can be demodulated by applying this correlation process to the received satellite signal using the local code.

The data acquisition unit acquires time information and positioning information from the navigation message demodulated by the baseband unit. The navigation message contains preamble data, a handover word (HOW) and TOW (time of week, also called the Z count) value, and subframe data. The subframe data includes subframe 1 to subframe 5, and each subframe contains the week number, satellite correction data including satellite health information, ephemeris data (precise orbit information for each GPS satellite 5), and an almanac (approximate orbit information for all GPS satellites 5). The data acquisition unit can therefore obtain the satellite time information and positioning information by extracting specific data from the received navigation message.

As shown in FIG. 3, the electronic device 100 divides the Earth into plural regions using longitude and latitude values, and manages the time difference to UTC by region. More specifically, each region is managed correlated to time difference information (time zone information) indicating the time difference in that region. The regions can be sized as desired, and different regions can be the same or different sizes. However, one time zone is set for one region. For example, the region at the bottom left corner in FIG. 3 includes time zones that are UTC+2 and time zones that are UTC+3, but because the time zone with the largest area in this region is UTC+3, the time difference assigned to this region is +3.

In addition to programs executed by the CPU 20 and the UTC offset, plural first correction data records corresponding to the plural regions described above are stored in EEPROM 32.

This first correction data is data for correcting the display time, and first correction data is stored in EEPROM 32 for each of the regions described above as shown in FIG. 4. Each first correction data record includes a region number, northwest coordinate (longitude and latitude), southeast coordinate (longitude and latitude), and time difference information (time zone information). The region number uniquely identifies a particular region. The northwest and southeast coordinates respectively identify the locations of the northwest and southeast corners of the region. The time difference is the time difference assigned to that region.

EEPROM 32 thus functions as a first storage unit in which time zone information indicating the time difference from UTC is previously stored for each region.

Second correction data that is used preferentially to the first correction data is stored for selected regions in flash ROM 33. This second correction data is also used to adjust the display time. This second correction data is not initially stored in the flash ROM 33, and is added to or overwritten by the display time correction process described below. As shown in FIG. 5, the content of the second correction data is the same as the first correction data.

The flash ROM 33 thus functions as a second storage unit that stores correlated region and time difference information.

CPU 20 uses the RAM 31 as working memory, and performs various calculations and control operations by running programs stored in EEPROM 32. As a result, the CPU 20 functions as a timekeeping unit, first correction unit, second correction unit, and control unit. Timekeeping is done by counting the pulses of a reference signal from an oscillation circuit not shown, for example.

When correction information described below is supplied, the CPU 20 (first correction unit) adjusts the display time based on the correction information and the satellite time information. More specifically, the CPU 20 adjusts the GPS time derived from the satellite time information with the UTC offset to get UTC, then adds the time difference indicated by the correction information described below to the calculated UTC, and uses the resulting time as the internal time.

When an operation signal corresponding to operation of the crown 7 is output from the operating unit 40, the CPU 20 (second correction unit) corrects the display time based on this operation signal, and generates time difference information representing the time difference between UTC and the corrected display time.

Note that the CPU 20 also controls driving the display unit 50 (hands 3 and display 4) so that the display time is displayed. As a result, the display time is displayed on the display unit 50.

When an operation signal denoting operation of the button 6*a* is output, the CPU 20 executes a process (correction process) that adjusts the display time due to the time difference. More specifically, when button 6*a* is pressed, the CPU 20 controls driving the GPS device 10 and causes the GPS device 10 to receive a satellite signal.

When the satellite time information and positioning information are output from the GPS device 10, the CPU 20 (control unit) references flash ROM 33, and determines if this positioning information is in a region corresponding to time difference information stored in the second correction data. If it is, the CPU 20 corrects the display time using this time difference information as the correction information. If it is not, the CPU 20 references the EEPROM 32, and corrects the display time using the time zone information (first correction data) for the region containing the received positioning information as the correction information.

More specifically, if the function of the CPU 20 that corrects the display time using the correction information is a first correction unit, it supplies time difference information from the second correction data as the correction information sent to the first correction unit when this positioning information is in a region for which time difference information is stored in the second correction data, but otherwise supplies time zone information contained in the first correction data as the correction information sent to the first correction unit. The second correction data is thus used preferentially to the first correction data.

A-2 Operation

The operation of the GPS device 10 is described next.

The following description assumes that the user of the electronic device 100 operates the button 6*a* on plural occasions in the same region. For example, a user that lives in Japan may wear the electronic device 100 on plural different visits to Tajikistan and press the button 6*a* each time upon arrival at an airport in Tajikistan (see FIG. 3). As described above, a correction process executes each time the button 6*a* is pressed.

Figure 6:
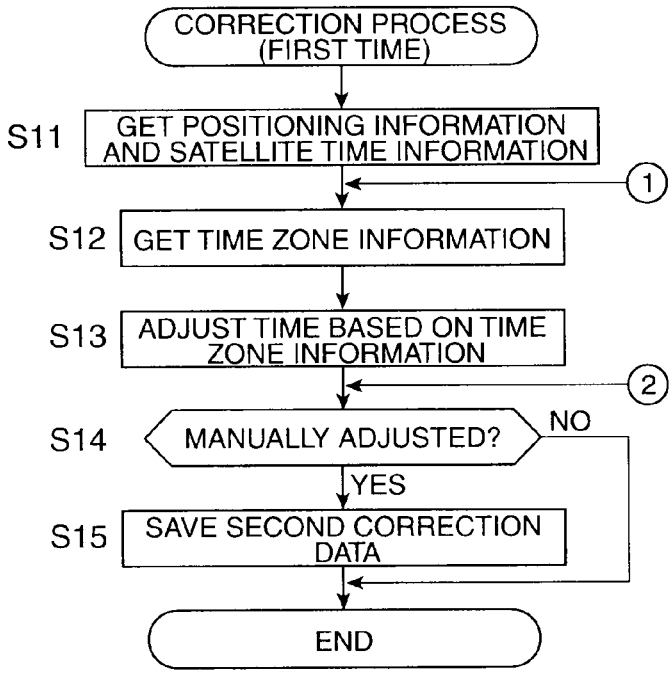
FIG. 6 is a flow chart of a first correction process executed by the electronic device 100.
Figure 7:
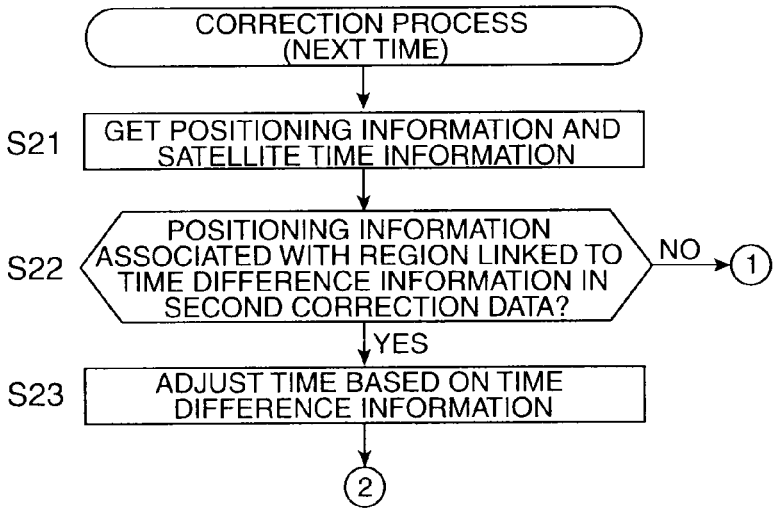
FIG. 7 is a flow chart of a second correction process executed by the electronic device 100 after the first correction process has been executed.

FIG. 6 and FIG. 7 are flow charts of the correction processes. FIG. 6 shows the correction process executed the first time a location is visited, and FIG. 7 shows the correction process executed the second and subsequent times the same location is visited.

As shown in FIG. 6, when the CPU 20 detects operation of button 6*a* on the first visit, the CPU 20 controls driving the GPS device 10 to acquire the positioning information and satellite time information (S11).

Next, the CPU 20 retrieves the time zone information corresponding to the acquired positioning information (S12). More specifically, the CPU 20 reads the first correction data for the region in which the location identified by the acquired positioning information is located (see FIG. 3) from EEPROM 32.

The CPU 20 then corrects the time based on the time zone information contained in the first correction data that was read (S13). More specifically, the display time is adjusted using the time zone information and the satellite time information. Yet more specifically, the UTC offset is added to the GPS time denoted by the satellite time information to calculate UTC, the time difference represented by the time zone information is added to the calculated UTC to get the current local time, and the calculated current local time is set as the internal time.

The CPU 20 then determines if the display time was corrected by operating the crown 7, that is, if the time was set manually (S14). This determination is made when a specific time (such as 30 minutes) has passed after adjusting the display time based on the time zone information is completed in the current correction process. This decision returns YES if an operation signal indicating operation of the crown 7 is output from the operating unit 40, that is, if the time is manually adjusted, within a specified time after the time is adjusted automatically based on the time zone information, and returns NO if the time was not manually adjusted.

Passage of a specified time is used as a condition for determining manual adjustment because time is required for the user to determine whether or not the automatic adjustment based on predetermined time zone information is correct. In other words, this specified time only needs to be long enough to enable easily determining if the automatic adjustment is correct, and this specified time could be set by the user.

If step S14 returns NO, the CPU 20 ends the correction process. If step S14 returns YES, the CPU 20 stores the second correction data (S15) and then ends the correction process. In step S15 the CPU 20 processes the first correction data read in step S12 to generate and store second correction data (see FIG. 5) in flash ROM 33. This process produces the second correction data by changing the time zone information of the first correction data to the time difference information resulting from operation of the crown 7 (functionally generating the second correction data by means of the second correction unit).

As shown in FIG. 7, the next time the user visits the same location, the CPU 20 controls driving the GPS device 10 to acquire the positioning information and satellite time information (S21).

Next, the CPU 20 determines if the acquired positioning information is in a region for which time difference information is contained in the second correction data (S22). More specifically, the CPU 20 determines if time difference information for the region containing the location identified by the acquired positioning information is stored in flash ROM 33. If the result of this decision is NO, the process goes to step S12 in FIG. 6. More specifically, the correction process that is executed the first time a particular locale is visited is executed.

If the result of step S22 is YES, the CPU 20 reads the time difference information from flash ROM 33, and adjusts the time using the read time difference information (S23). More specifically, the display time is adjusted using the time difference information and the satellite time information. Yet more specifically, the UTC offset is added to the GPS time denoted by the satellite time information to calculate UTC, the time difference represented by the time difference information is added to the calculated UTC to get the current local time, and the calculated current local time is set as the internal time.

The process then goes to step S14 in FIG. 6. This is because the time may be set manually even though this is not the first time visiting this location.

As described above, this first embodiment of the invention adjusts the display time based on time zone information, and when the user determines that this automatic setting is incorrect and manually adjusts the display time, stores this time difference correlated to the region for which the manual adjustment was made. Automatically setting the time based on time zone information may thus be inappropriate when the region corresponding to the time zone information is larger than the actual time zone. More specifically, a single representative time zone may be assigned to a single region even though plural time zones are actually contained in that region. When travelling on business to a foreign country, for example, the same destination is commonly visited on multiple trips. By storing the time difference obtained when the time is manually set for the current location, this embodiment of the invention can automatically adjust the display time the next time the user visits the same place by using the time difference based on the manual adjustment, and can thus improve the convenience of the electronic device 100.

B Embodiment 2

B-1 Configuration

The configuration of an electronic device 200 according to the second embodiment of the invention is described next. The configuration of this electronic device 200 differs from the configuration of the electronic device 100 only in the program that is stored in EEPROM 32 and the content of the second correction data stored in flash ROM 33. Program differences are described below as differences in the operation of the electronic device 200.

Note that in this embodiment of the invention the display time is the internal time, and correcting the display time means correcting the internal time.

Figures 8, 9:
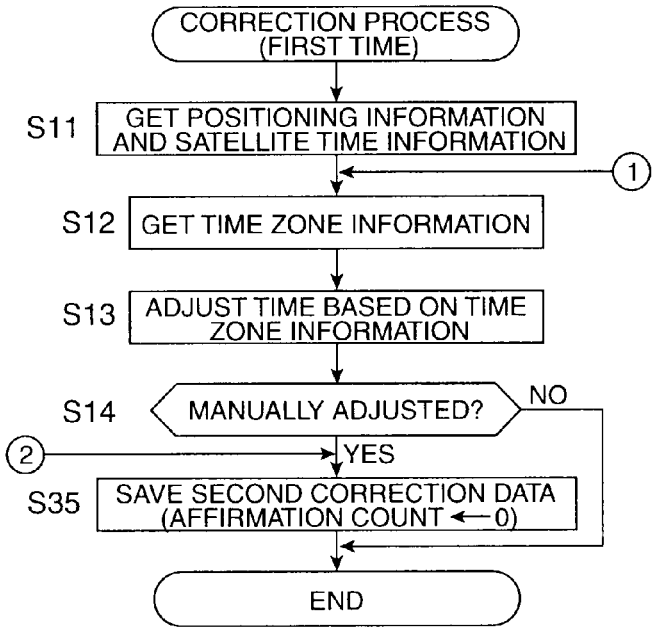
FIG. 8 schematically describes an example of second correction data stored in flash ROM 33 in an electronic device 200 according to a second embodiment of the invention.
FIG. 9 is a flow chart of a first correction process executed by the electronic device 200.

FIG. 8 shows the content of the second correction data stored in flash ROM 33. As shown in the figure, each second correction data record includes a region number, northwest coordinate, southeast coordinate, time difference information, and affirmation count. This affirmation count information indicates the number of times (the affirmation count) after the second correction data is generated that the positioning information for the region corresponding to the time difference information is output from the GPS device 10 and the corrected display time is not corrected based on an operation signal. The meaning of "affirmation" here is described below in the operation of the electronic device 200.

B-2 Operation

The operation of the electronic device 200 is described next.

As in the first embodiment, the user of the electronic device 200 is assumed to operate the button 6*a* on plural occasions in the same region. Like the electronic device 100, this electronic device 200 runs the correction process when a button 6*a* is operated. Operation of the electronic device 200 differs from operation of the electronic device 100 only in the content of the correction process.

Figure 10:
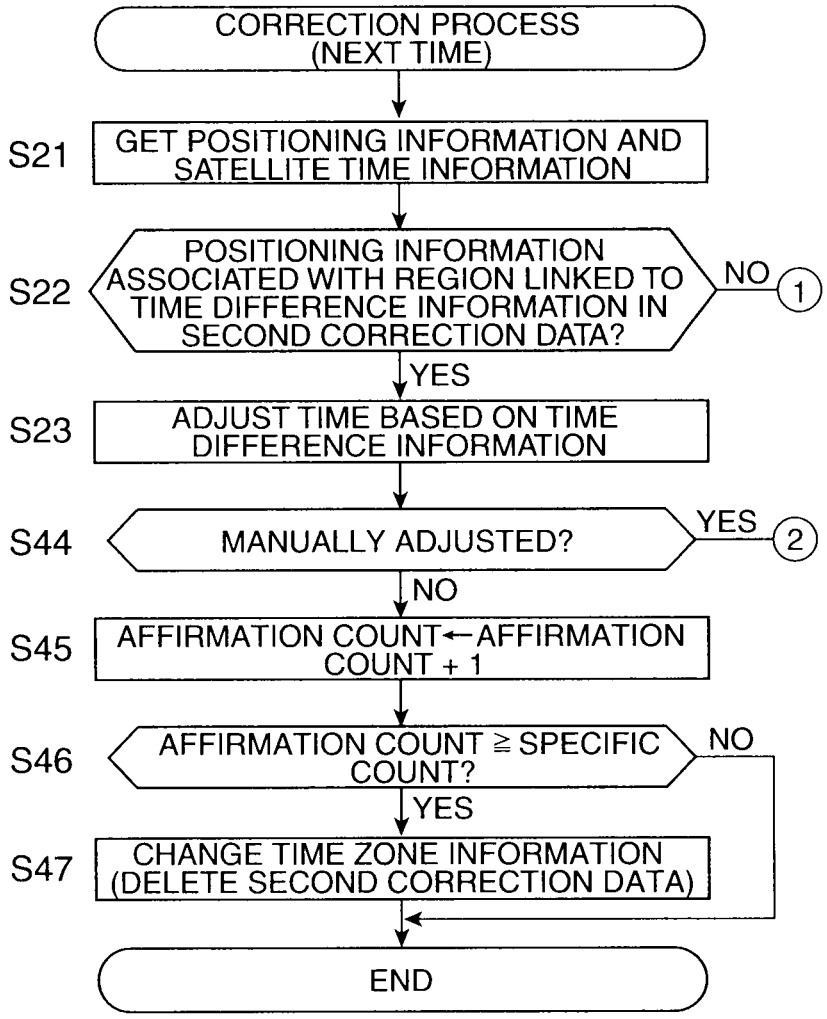
FIG. 10 is a flow chart of a second correction process executed by the electronic device 200 after the first correction process has been executed.

FIG. 9 and FIG. 10 are flow charts of the correction processes. FIG. 9 shows the correction process executed the first time a location is visited, and FIG. 10 shows the correction process executed the second and subsequent times the same location is visited.

The correction process in FIG. 9 differs from the correction process in FIG. 6 only in the execution of step S35 instead of step S15. Step S35 is a process in which the second correction data is stored, and in this process the CPU 20 changes the time zone information of the first correction data to the time difference information generated by the second correction unit based on operation of the crown 7, and adds affirmation count information denoting 0 (zero) to initialize the second correction data.

The correction process in FIG. 10 differs from the correction process in FIG. 7 in the addition of steps S44 to S47 after step S23. The CPU 20 determines in step S44 if the time was manually set, and if the decision is YES goes to step S35 in FIG. 9. If the decision is NO, the CPU 20 changes the second correction data for the region containing the location identified by the positioning information acquired in step S21 so that the affirmation count indicated by the affirmation count information is incremented 1 (S45).

If the display time that was automatically corrected based on the time difference information is not manually adjusted, the adjustment most likely matches the setting expected by the user, and the time difference information may be determined to have been affirmed by the user. This is the meaning of "affirm" herein. In other words, the affirmation count indicated by the affirmation count information contained in the same second correction data record as the time difference information indicates the number of times that the time difference information was affirmed by the user.

The CPU 20 then determines if the updated affirmation count is greater than or equal to a specific count (such as 3) (S46). If the decision is NO, the CPU 20 ends the correction process. If the decision is YES, the CPU 20 changes the time zone information for the region according to the time difference information corresponding to the region containing the location identified by the positioning information acquired in step S21 (S47), and ends the correction process. This change of the time zone information changes the first correction data so that it contains this time difference information as the time zone information for that region.

As described above, this second embodiment of the invention can reflect the second correction data in the first correction data under specific conditions, and delete the second correction data from the flash ROM 33. The storage capacity of the flash ROM 33 can therefore be used effectively.

A drop in the reliability of the time zone information can also be suppressed because only second correction data with an affirmation count greater than or equal to a specific count, that is, only high reliability second correction data, is selected from the second correction data stored in flash ROM 33 for deletion and updating the first correction data.

C Variations

The invention is not limited to the first and second embodiments described above, and variations obtained by modifying these embodiments are included in the scope of technology covered in the accompanying claims. Some such variations of the foregoing embodiments are described below. Embodiments obtained by combining two or more of the following variations are also included in the scope of technology described in the accompanying claims.

For example, one variation of the foregoing embodiments is configured to adjust the display time with consideration for daylight savings time (DST, also known as summer time). Because the period when DST is in effect can be changed by law, these variations can preferably change the time period when DST is in effect. A variation in which the time when daylight saving time is in effect (the "DST period" herein) can be changed is described below as a variation (variation 1) of the foregoing first embodiment.

C-1 Variation 1

FIG. 11 schematically describes the content of the first correction data stored in the EEPROM 32 of an electronic device according to this first variation, and FIG. 12 schematically describes the content of the second correction data stored in flash ROM 33 in the electronic device. As will be known from these figures, the first correction data and second correction data both include DST start information denoting the date and time (month, day, hour, minute, second) that daylight saving time starts, and DST end information indicating the date and time DST ends. The first storage unit (EEPROM 32) thus also stores summer time information specifying when DST is in effect in each region.

Figure 13:
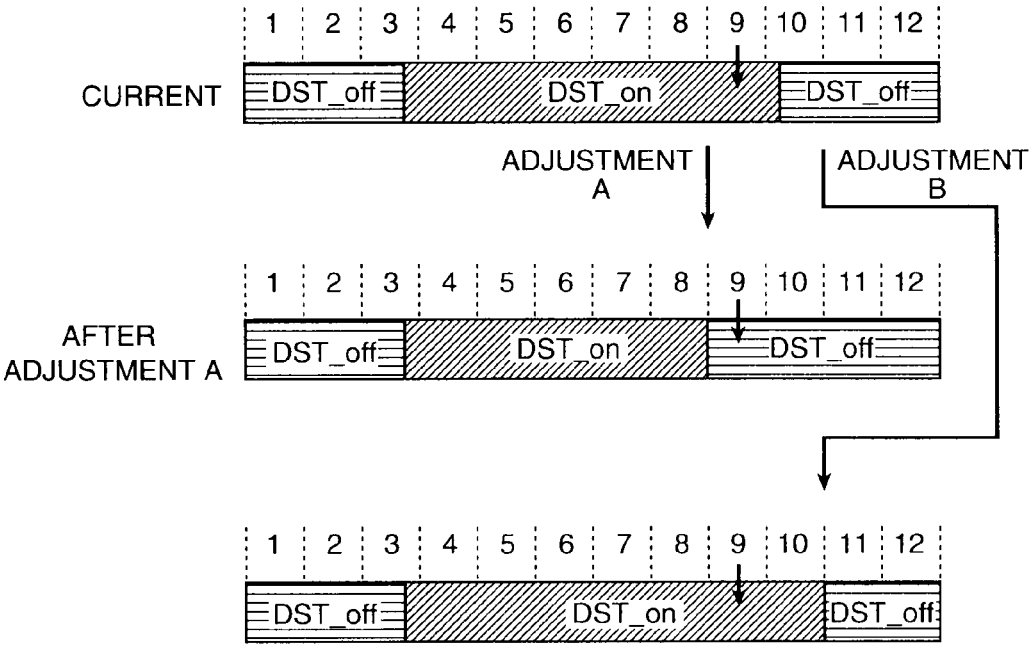
FIG. 13 describes displaying the time when daylight savings time (summer time) is in effect.

In variation 1, the CPU 20 can display an image indicating whether or not DST is in effect on the display unit 50 (display 4) normally or in response to a user action. As shown in the "current" line in FIG. 13, this variation displays an image that graphically indicates when DST is in effect (the DST_on period) and is not in effect (the DST_off period).

Functioning as the second correction unit, the CPU 20 changes the image displayed on the display unit 50 and generates corrected DST information matching the corrected image based on the operation signals output from the operating unit 40 between when the button 6*b* is operated and when button 6*a* and button 6*b* are then operated simultaneously. For example, the image displayed on the display unit 50 changes to the image that is presented "after adjustment A" in FIG. 13 when adjustment A is performed in advance of the date and time when DST ends, and changes to the image shown "after adjustment B" in FIG. 13 when adjustment B is performed to delay the end of DST.

Note that the corrected DST information includes the DST start information and DST end information.

In this variation 1, step S14 in FIG. 6 also returns YES when the above image corresponding to the region containing the location identified by the positioning information acquired from the GPS device 10 changes. The DST start information and DST end information that is stored in the second correction data in flash ROM 33 in step S15 is the DST start information and DST end information that constituted the corrected DST information. More specifically, when the user manipulates the operating unit and changes the image that is displayed on the display unit according to whether or not daylight saving time is in effect, the CPU 20 functions as a control unit that stores the corrected DST information correlated to the positioning information in the second storage unit.

Functioning as a control unit in step S13 in FIG. 6, the CPU 20 supplies information reflecting the DST information contained in the first correction data read from EEPROM 32 in the time zone information contained in the same first correction data to the first correction unit as the correction information. For example, if the time zone value is +2, the time zone value in the DST_on period is +2+1=+3, and is +2 in the DST_off period.

Functioning as a control unit in step S23 in FIG. 7, the CPU 20 supplies information reflecting the corrected DST information contained in the second correction data read from flash ROM 33 in the time difference information contained in the same second correction data to the first correction unit as the correction information. For example, if the time difference is +2, the time difference in the DST_on period is +2+1=+3, and is +2 in the DST_off period.

C-2 Variation 2

Functioning as a second correction unit in the foregoing embodiments, the CPU 20 generates the second correction data when the display time is manually adjusted before a specified time passes after the positioning information is output, but the condition for generating the second correction data is not so limited. For example, the second correction data may be generated when the time is set manually after the positioning information is output and before an operation signal corresponding to operation of the button 6*a* is output next from the operating unit 40.

C-3 Variation 3

The foregoing embodiments could also be modified so that the regions can be shaped as desired without conforming to longitude or latitude lines. However, if the regions are shaped along both longitude and latitude lines, each region can be identified using coordinates for only two points, and can be easily compared with the acquired positioning information.

Furthermore, while each region is identified by two coordinate positions in the foregoing embodiments, the regions could alternatively be identified using the coordinates for one point and the size of the region (such as the length of the diagonal).

C-4 Variation 4

The internal time is used as the display time in the foregoing embodiments, but the display time may be a time based on the internal time, and a time that is different from the internal time may be used as the display time. For example, UTC or the local time in a specific place (such as Tokyo) could be set as the internal time, and the display time could be derived from the internal time and time zone information (or time difference information stored in flash ROM 33). In this case adjusting the display time does not mean adjusting the internal time.

C-5 Variation 5

Instead of determining if the acquired positioning information belongs to a region corresponding to the time difference information contained in the second correction data in step S22 in FIG. 7 or FIG. 10, another variation of the foregoing embodiments determines whether or not the distance between the acquired positioning information and the positioning information contained in the second correction data is less than or equal to a specified distance. In this case the second correction data includes positioning information identifying a single location (longitude and latitude) instead of northwest coordinate and southeast coordinate information.

More specifically, if an embodiment of the invention incorporating the electronic devices 100 and 200 described above is considered a first embodiment, a second embodiment of the invention is an electronic device including: a timekeeping unit that keeps internal time; a display unit that displays a display time based on the internal time; a reception unit that receives satellite signals transmitted from satellites and outputs positioning information and satellite time information corresponding to a reference time based on the received signals; a first correction unit that adjusts the display time based on the satellite time information and correction information; a first storage unit that stores time zone information denoting the time difference to the reference time for each region; an operating unit that outputs an operation signal corresponding to user operations; a second correction unit that adjusts the display time based on the operation signal, and generates time difference information indicating the time difference between the reference time and the corrected display time; a second storage unit that correlates and stores the time difference information and the positioning information; and a control unit that, when positioning information and satellite time information are output from the reception unit, executes a process that calculates the distance between the positioning information output from the reception unit and the positioning information stored in the second storage unit, a process that determines if the calculated distance is less than or equal to a specific distance, a process that supplies the time difference information as the correction information to the first correction unit when the calculated distance is less than the specific distance, and a process that supplies the time zone information as the correction information to the first correction unit when the calculated distance is less than the specific distance.

C-6 Other Variations

To reduce the required storage capacity of the EEPROM 32, the foregoing embodiments could also be changed so that a plurality of first correction data records are compressed together and the resulting compressed data is stored in EEPROM 32. This configuration requires overwriting the compressed data (plural first correction data records) when any of the first correction data is changed. However, when the second correction data is stored in flash ROM 33 as described in the first embodiment, there is no need to rewrite the first correction data and the CPU 20 load therefore does not increase. In addition, when only second correction data that is considered to be reliable is selected and written as first correction data to the EEPROM 32 after the second correction data is written to flash ROM 33 as described in the second embodiment, an increase in the CPU 20 load can also be suppressed because the number of times the first correction data is rewritten is kept low.

Other variations are also possible. For example, a configuration that uses a digital timepiece without hands as the electronic device of the invention is also conceivable.

The invention is also not limited to wristwatches, and can also be applied to pocket watches, for example.

The invention is further not limited to electronic timepieces, and can be used in other types of electronic devices having other functions in addition to a timekeeping function. Examples of such electronic devices include cell phones and navigation devices having a GPS function and a timekeeping function.

The positioning information satellites used by the electronic device according to the invention are not limited to GPS satellites. For example, the invention can be used with Global Navigation Satellite Systems (GNSS) such as Galileo (EU), GLONASS (Russia), and Beidou (China), and other positioning information satellites that transmit satellite signals containing satellite time information, including the SBAS and other geostationary or quasi-zenith satellites.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2010-109973, filed May 12, 2010 is expressly incorporated by reference herein.

What is claimed is:

1. An electronic device comprising:

a timekeeping unit that keeps internal time;

a display unit that displays a display time based on the internal time;

a reception unit that receives satellite signals transmitted from satellites and outputs positioning information and satellite time information corresponding to a reference time based on the received signals;

a first correction unit that adjusts the display time based on the satellite time information and correction information;

a first storage unit that stores time zone information denoting the time difference to the reference time for each region;

an operating unit that outputs an operation signal corresponding to user operations;

a second correction unit that adjusts the display time based on the operation signal, and generates time difference information based on the operation signal, the time difference information indicating the time difference between the reference time and the corrected display time;

a second storage unit, different from the first storage unit, that correlates and stores the time difference information generated by the second correction unit with the region identified by the positioning information; and a control unit that, when positioning information is output from the reception unit, executes a process of determining if the positioning information identifies a region corresponding to time difference information stored in the second storage unit, executes a process of supplying the time difference information as the correction information to the first correction unit when the positioning information identifies a region in the second storage unit, and when the positioning information does not identify a region in the second storage unit, executes a process of referencing the first storage unit and supplying the time zone information corresponding to the region identified by the positioning information as the correction information to the first correction unit;

wherein:

the control unit counts the number of times that, after the time difference information is generated, positioning information for the region corresponding to the time difference information is output from the reception unit but the display time corrected in the first correction unit is not corrected in the second correction unit, and overwrites the time zone information in the first storage unit with the time difference information when the count reaches a specific value.

2. The electronic device described in claim 1, wherein:

the control unit counts the number of times that, after the time difference information is generated, positioning information for a location at a distance that is less than or equal to a specific distance from the location identified by the positioning information for the region corresponding to the time difference information is output from the reception unit but the display time corrected in the first correction unit is not corrected in the second correction unit, and overwrites the time zone information in the first storage unit with the time difference information when the count reaches a specific value.

3. The electronic device described in claim 1, wherein:

the display unit displays a daylight saving time symbol indicating whether or not daylight saving time is in effect;

the first storage unit stores daylight saving time information specifying the daylight saving time period for each region;

the second correction unit corrects displaying the daylight saving time symbol that is presented on the display unit based on the operation signal, and generates corrected daylight saving time information indicating the corrected date and time; and the control unit executes a process of storing the corrected daylight saving time information correlated to the positioning information in the second storage unit when a user operates the operating unit and changes the daylight saving time symbol displayed on the display unit, and when positioning information is output from the reception unit, executes a process of calculating the distance between the positioning information output from the reception unit and the positioning information stored in the second storage unit, executes a process of determining if the calculated distance is less than or equal to a specific distance, executes a process of supplying information reflecting the corrected daylight saving time information in the time difference information as the correction information to the first correction unit when the calculated distance is less than or equal to the specific distance, and executes a process of supplying information reflecting the daylight saving time information in the time zone information as the correction information to the first correction unit when the calculated distance exceeds the specific distance.

4. The electronic device described in claim 1, wherein:

the second correction unit generates the time difference information when the display time is corrected based on the operation signal before a specific time passes after the positioning information is output.

5. The electronic device described in claim 1, wherein:

the first storage unit stores time zone information for regions segmented by longitude and latitude.

6. An electronic device comprising:

a timekeeping unit that keeps internal time;

a display unit that displays a display time based on the internal time;

a reception unit that receives satellite signals transmitted from satellites and outputs positioning information and satellite time information corresponding to a reference time based on the received signals;

a first correction unit that adjusts the display time based on the satellite time information and correction information;

a first storage unit that stores time zone information denoting the time difference to the reference time for each region;

an operating unit, that outputs an operation signal corresponding to user operations;

a second correction unit that adjusts the display time based on the operation signal, and generates time difference information based on the operation signal, the time difference information indicating the time difference between the reference time and the corrected display time;

a second storage unit, different from the first storage unit, that correlates and stores the time difference information generated by the second correction unit with the region identified by the positioning information; and a control unit that, when positioning information is output from the reception unit, executes a process of determining if the positioning information identifies a region corresponding to time difference information stored in the second storage unit, executes a process of supplying the time difference information as the correction information to the first correction unit when the positioning information identifies a region in the second storage unit, and when the positioning information does not identify a region in the second storage unit, executes a process of referencing the first storage unit and supplying the time zone information corresponding to the region identified by the positioning information as the correction information to the first correction unit;

wherein:

the display unit displays a daylight saving time symbol indicating whether or not daylight saving time is in effect;

the first storage unit stores daylight saving time information specifying the daylight saving time period for each region;

the second correction unit corrects displaying the daylight saving time symbol that is presented on the display unit based on the operation signal, and generates corrected daylight saving time information indicating the corrected date and time; and the control unit executes a process of storing the corrected daylight saving time information correlated to the region identified by the positioning information in the second storage unit when a user operates the operating unit and changes the daylight saving time symbol displayed on the display unit, and when positioning information is output from the reception unit, executes a process of determining if the positioning information identifies a region corresponding to time difference information stored in the second storage unit, executes a process of supplying information reflecting the corrected daylight saving time information in the time difference information as the correction information to the first correction unit when the positioning information identifies said region, and executes a process of referencing the first storage unit and supplying information reflecting the daylight saving time information in the time zone information for the region identified by the positioning information as the correction information to the first correction unit when the positioning information does not identify said region.

7. An electronic device comprising:

a timekeeping unit that keeps internal time;

a display unit that displays a display time based on the internal time;

a reception unit that receives satellite signals transmitted from satellites and outputs positioning information and satellite time information corresponding to a reference time based on the received signals;

a first correction unit that adjusts the display time based on the satellite time information and correction information;

a first storage unit that stores time zone information denoting the time difference to the reference time for each region;

an operating unit that outputs an operation signal corresponding to user operations;

a second correction unit that adjusts the display time based on the operation signal, and generates time difference information indicating the time difference between the reference time and the corrected display time;

a second storage unit that correlates and stores the time difference information and the positioning information; and a control unit that, when positioning information is output from the reception unit, executes a process of calculating the distance between the positioning information output from the reception unit and the positioning information stored in the second storage unit, a process of determining if the calculated distance is less than or equal to a specific distance, a process of supplying the time difference information as the correction information to the first correction unit when the calculated distance is less than the specific distance, and a process of supplying the time zone information as the correction information to the first correction unit when the calculated distance is less than the specific distance.

8. An electronic device comprising:

a display unit that displays a display time;

a reception unit that receives a satellite signal transmitted from a satellite and outputs positioning information and satellite time information corresponding to a reference time based on the received signal;

a first correction unit that adjusts the display time based on the satellite time information and correction information;

a first storage unit that stores time zone information denoting the time difference to the reference time for each region;

a second correction unit that adjusts the display time based on a user operation signal, and generates time difference information based on the user operation signal, the time difference information indicating the time difference between the reference time and the corrected display time;

a second storage unit, different from the first storage unit, that stores time difference information generated based on user operation with a region; and a control unit that, when positioning information is output from the reception unit, executes a process of determining if the positioning information identifies a region corresponding to time difference information stored in the second storage unit, executes a process of supplying the time difference information as the correction information to the first correction unit when the positioning information identifies a region in the second storage unit, and when the positioning information does not identify a region in the second storage unit, executes a process of referencing the first storage unit and supplying the time zone information corresponding to the region identified by the positioning information as the correction information to the first correction unit.

wherein:

the control unit counts the number of times that, after the time difference information is generated, positioning information for the region corresponding to the time difference information is output from the reception unit but the display time corrected in the first correction unit is not corrected in he second correction unit, and overwrites the time zone information in the first storage unit with the time difference information when the count reaches a specific value.

* * * * *